US005320455A

United States Patent [19]

Mattox

[11] Patent Number: 5,320,455

[45] Date of Patent: Jun. 14, 1994

[54] GEOCELL WITH FACING PANEL

[75] Inventor: Robert M. Mattox, Mobile, Ala.

[73] Assignee: The Tensar Corporation, Morrow, Ga.

[21] Appl. No.: 872,113

[22] Filed: Apr. 22, 1992

[51] Int. Cl.[5] ..... E02D 29/02

[52] U.S. Cl. ..... 405/284; 405/258; 405/262

[58] Field of Search ..... 405/284, 286, 32, 16; 52/441, 415, 439

[56] References Cited

U.S. PATENT DOCUMENTS

| | | | |
|---|---|---|---|
| 1,323,884 | 12/1919 | McBean | 405/284 |
| 1,964,870 | 7/1934 | Chappell | 52/415 X |
| 4,483,640 | 11/1984 | Berger et al. | 405/32 X |
| 4,530,622 | 7/1985 | Mercer . | |

FOREIGN PATENT DOCUMENTS

| | | | |
|---|---|---|---|
| 1095729 | 12/1954 | France | 405/285 |
| 0202126 | 9/1987 | Japan | 405/284 |
| 2167794 | 6/1986 | United Kingdom | 405/284 |

OTHER PUBLICATIONS

Information Bulletin, Tensar Geocell Installation Procedure, IB/Geocell/IO.88, 4 pages.

Tensar Geocell Mattress, 4 pages.

Tensar Geogrids in Civil Engineering, 27 pages.

*Primary Examiner*—Dennis L. Taylor

*Attorney, Agent, or Firm*—Jacobson, Price, Holman & Stern

[57] ABSTRACT

A facing panel is added to a surface of a geocell, on an outboard face of the cell, exposed to free water forces. The facing panel is filled with either stone, concrete, wooden boards, plastic sheets or steel sheets. In concrete usage, synthetic drainage is introduced to prevent the buildup of hydrostatic pressures behind the facing panel. The facing panel creates the ability to construct vertical retaining walls by stacking geocell units on top of each other and then filling a facing panel with either stone or concrete for a completed wall face. The geocell units are filled with sand or shell as retained in the geocells by geotextile liners. Circular geocells also retain fill in a geotechnical structure. Circular compartments are formed by connecting plastic mesh material at points on the compartment circumference, thus producing a cylindrical confinement of granular fill. The geotechnical structure thus formed may be used in a variety of applications such as bulkheads, vertical walls, wave breaks, the side of an artificial island, confinement berms, and columns to support vertical loads.

27 Claims, 9 Drawing Sheets

GEOCELL WITH FACING PANEL

FIELD OF THE INVENTION

This invention relates to geocell retaining wall structures and geocell retaining wall structures including a facing panel formed on a surface of the structure. A vertical retaining wall is formed by filling the geocells with sand and the facing panel with either stone or concrete in a limited area of the completed retaining wall structure so as to protect and reinforce the interconnected geocells.

BACKGROUND OF THE INVENTION

In U.S. Pat. No. 4,530,622 to Mercer, fill is disclosed as being retained in a geotechnical structure. A plastic material mesh, which has spaced, longitudinal, oriented strands, is used to form a retainer construction for retaining fill, such as sand. Triangular compartments are formed by a number of parallel elongate portions of the mesh which are interconnected by zig-zag portions. Each zig-zag portion is contained between two respective elongate portions and is joined to an adjacent zig-zag portion at respective corners of the formed compartments. The connections are made by transversely bending strands of one portion to form loops which project out of the opposite side of the other portion, and passing a connecting member through the loops to prevent the loops from being pulled back.

The geotechnical structure of the Mercer patent includes a retainer construction which need not be closed on all sides and need not have a bottom or top closure. When making up the container construction, a backing of textile material may be secured against the inner side of outer faces of the geotechnical structure, depending upon the location of the structure and in fill material to be used.

SUMMARY OF THE INVENTION

By the present invention, an improvement over the construction of a geotechnical structure according to the disclosure of the Mercer patent has been developed. If the backfill for the geocell consists of granular material having small particles (sand, for example), the geocell must be lined around the perimeter of the geocell with a geotextile to prevent the loss of the granular material through the apertures of the geogrid. On exposed faces of the geocell structure, the geotextile lining is subject to attack by ultraviolet radiation. The ultraviolet attack causes deterioration of the geotextile which will lead to a failure of the geotextile and ultimately the geocell itself. In an improved embodiment, a facing panel is added to a surface of a geocell on the exposed outboard face of the cell. The facing panel is filled with either stone, concrete, wooden boards, plastic sheets or steel sheets to provide a permanent face able to withstand the effects of the elements. If concrete is used, a synthetic drainage is introduced to prevent the buildup of hydrostatic pressures behind the facing panel. The advantage of this type of construction is that the geocell can be filled with less expensive materials such as sand or shell, thus substantially reducing the volume of rip rap for marine applications.

The facing panel creates the ability to construct vertical retaining walls by merely stacking geocell units on top of each other and then filling a facing panel with either stone or concrete for a completed wall face. The geocell units are filled with sand or shell as retained in the geocells by geotextile liners. These walls may be built on dry land or in the water.

There are times where specific site requirements prohibit the use of a vertical face. Geocells are then stacked to form a stair step geometry with a facing panel added to the forward and upper portions of the geocells.

In the case of stair step geometry, an upper horizontally extending portion of the geocell includes a facing panel located behind the small stone filled facing panel, filled with large stone to protect the sand fill from erosive forces generated by wave action. The size of the large rip rap fill of the facing panel is dependant upon the wave energy that is resisted.

By the present invention, a circular geocell is used for retaining fill in a geotechnical structure. Circular compartments are formed by connecting plastic mesh material at points on the compartment circumference, thus producing a cylindrical confinement of granular fill. The geotechnical structure thus formed may be used in a variety of applications, for example, bulkheads, vertical walls, wave breaks, the side of an artificial island, confinement berms, and columns to support vertical loads.

Each circular geocell includes sand fill retained by a geotextile liner. An additional strip of geotextile is placed on the geocell at the Bodkin connection between adjacent cells, however spaced from the Bodkin joint. This prevents the loss of fill material through the Bodkin joint. The use of circular geocells is advantageous in that as they are filled with sand or other fill, they automatically flex to assume a circular shape with equal tensioning about their periphery. Adjacent circular geocells are connected with a Bodkin joint, and any tensioning of a row of circular geocells needs to be in a single direction, across their diameters. In contrast, triangular and other non-circular geocells need to be first staked at their corners and tensioned prior to filling. It is only until being partially filled that the non-circular geocells can retain their shape.

Alternately, a circular geocell may be used with or without a facing panel lining on at least one side of an outer surface of the cell for resistance against wave action and confinement of fill on the side opposite the stone filled face. Again, the facing panel is filled with small stone, concrete, wooden boards, plastic sheets or steel sheets. The side of the circular geocells in contact with the stone filled facing panel retains the fill of the geocells and avoids exposure of the fill of the geocells to the wave action elements.

If a facing panel is used in combination with a circular geocell, the facing panel is constructed of a series of facing panel compartments, again with Bodkin joints, thus making the assembly simple and at the same time, ensuring connective strength of the uniaxial (UX) material. The uniaxial material is made in accordance with the disclosure of U.S. Pat. No. 4,374,798, to Mercer, hereby incorporated by reference.

A facing panel located on all sides of a circular geocell is used for applications that would be fully surrounded by water, such as in jetties, wave breaks, etc. The geocell is formed by splicing together uniaxial material using Bodkin joints at the common locations. The circular geocell receives sand fill which is retained by lining the cell with a geotextile "sock". The formed cylinder of sand is completely encapsulated by a facing panel as reinforced by the geotextile liner to prevent loss of sand particles (fines) in underwater action.

The diameter and height of the circular geocells is a function of the application in which the geocells are used. If the geocells are used as a bulkhead, for example, then the geocell is dimensioned to create a gravity retaining structure based on the earth pressure generated behind the geocells. The engineering for this application would include base sliding, overturning, internal shear and tension in the UX material forming the circular geocell. Construction of these cells is simple and fast.

Sand fill is placed first either mechanically into the cell or by hydraulically filling each cell. After the sand fill is completed, the facing panel would then be filled with either stone or concrete. When using concrete, special geosynthetic drainage is incorporated to prevent the buildup of hydrostatic pressures within the cells. This is accomplished by the use of several geosynthetic materials presently commercially available, including drainage composite available from The Tensar Corporation of Morrow, Ga.

Both circular geocells and rectangular geocells may be used in a wharf application. The construction of the cells may include a layer of UX geogrid placed across the base on the geocell to serve as an anchor. Connected to this layer of geogrid is a series of vertical UX geogrid members which rise around the perimeter of the cell up to the top of the geocell. These vertical members eventually are cast into a concrete deck and serve as an anchor device to prevent lifting of the deck under hydrostatic pressures created by waves, etc. The facing panel compartments located on both sides of the geocell are filled with stone up to a specified depth and the balance is filled with concrete which is integrated with the concrete slab on top of the geocells to form the deck of the wharf.

When circular geocells are used with a facing panel, the facing panel may include wooden boards, plastic sheets or steel sheets as fill material. This fill material forms a hard face for the geocell. The boards or sheets measure approximately two inches thick by eight inches wide and extend below the bottom surface of the geocell to a depth of approximately two to three feet into the surface below the geocell. This type of geocell and facing panel may be used as a bulkhead.

Typically, the height of individual geocells is limited to 1.3 m (4.62 feet). The height, however, is not limited to the width of material used. Circular geocells can be constructed to any height as long as the imposed hoop stress on the geogrid does not exceed the long term allowable design load. Calculations indicate that geocells with diameters up to thirty feet and a height of thirty-five feet can be built in water to depths of thirty feet. By using multiple layers of geogrid, earthen structures of greater heights than this can also be achieved. Thus, the geocell presents a multitude of marine applications including applications for groins, jetties, wave breaks, wharfs, piers, bulkheads, gabion erosion protection, and open water dredge spoil containment.

Both rectangular (formed from interconnected triangular geocells) and circular geocell configurations have an application as a structural component. Sand columns surrounded by geotextile and geogrid are utilized as a structural column for buildings with the outer perimeter of the column being formed with facing panel of concrete. The load bearing capacity of such a sand filled column is very dramatic. This structure may be used as a bridge support.

Both the rectangular and the circular geocell configuration may be used as a temporary or permanent retaining wall. The addition of the facing panel allows a permanent application with a concrete fill. Therefore, the geocells formed of UX geogrid are ideally suited for marine use in either fresh or salt water.

It is an object of the present invention to provide a geocell wall structure having a facing panel forming a retaining structure.

It is another object of the present invention to provide a geocell structure in either rectangular or circular configuration with a facing panel filled with stone or concrete to reinforce the geocell structure filled with sand.

It is still yet another object of the present invention to provide a facing panel in a curved configuration on both sides of a circular geocell, filled with either stone or concrete, to provide a reinforcing retaining structure.

It is still yet another object of the present invention to provide a rectangular geocell having facing panels in front and on top of individual geocells which are stacked in a stair step configuration to provide a reinforced retaining structure for a marine application.

It is still yet another object of the present invention to provide a circular geocell without a facing panel.

It is still yet another object of the present invention to provide a circular geocell with a facing panel having wooden boards, plastic sheets or steel sheets located in the facing panel.

These and other objects of the invention, as well as many of the intended advantages thereof, will become more readily apparent when reference is made to the following description taken in conjunction with the accompanying drawings.

DETAILED DESCRIPTION OF THE PREFERRED EMBODIMENTS

Figure 1:
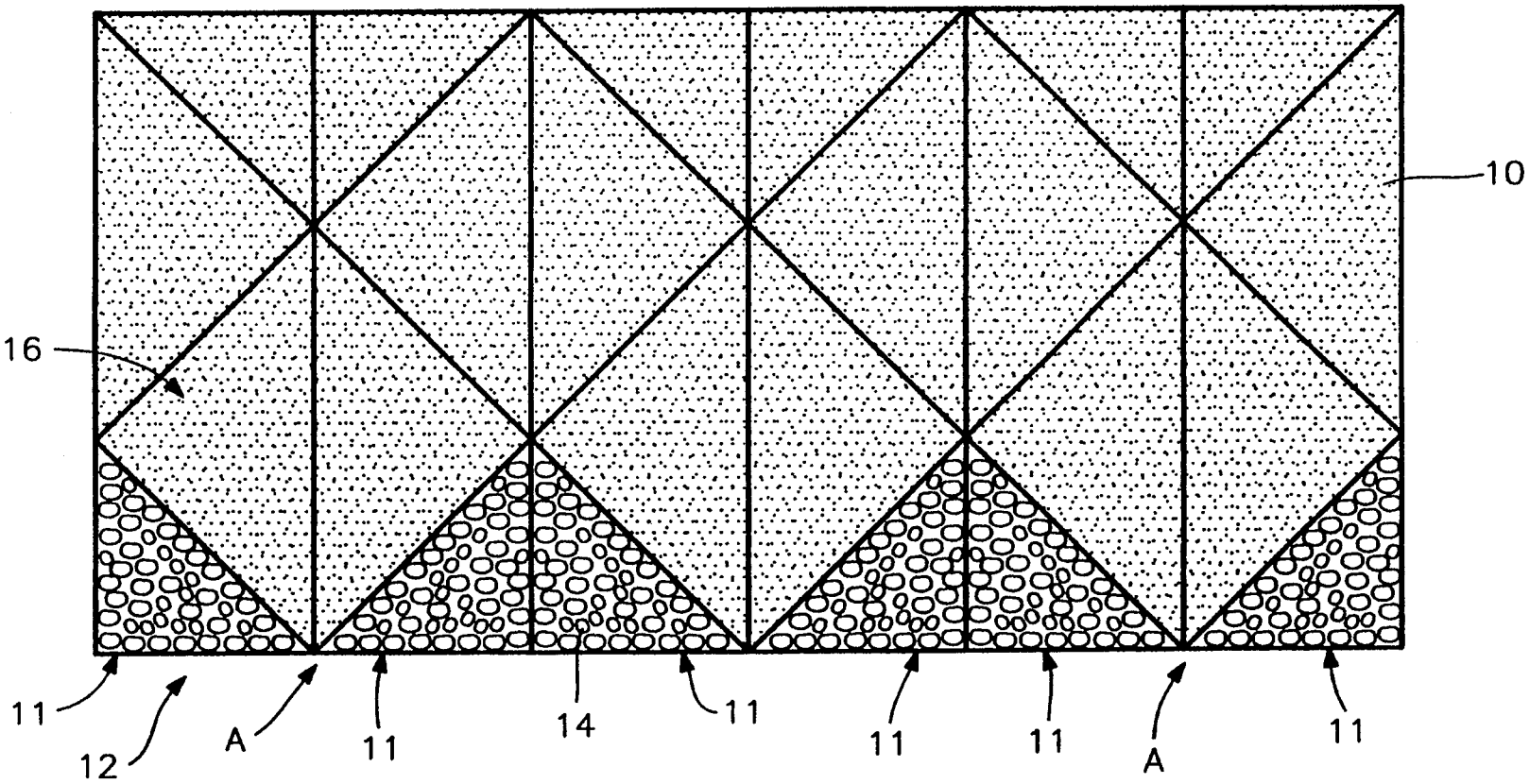
FIG. 1 is a plan view of a plurality of interconnected geocells.

In describing a preferred embodiment of the invention illustrated in the drawings, specific terminology will be resorted to for the sake in clarity. However, the invention is not intended to be limited to the specific terms so selected, and it is to be understood that each specific term includes all technical equivalents which operate in a similar manner to accomplish a similar purpose.

Figure 2:
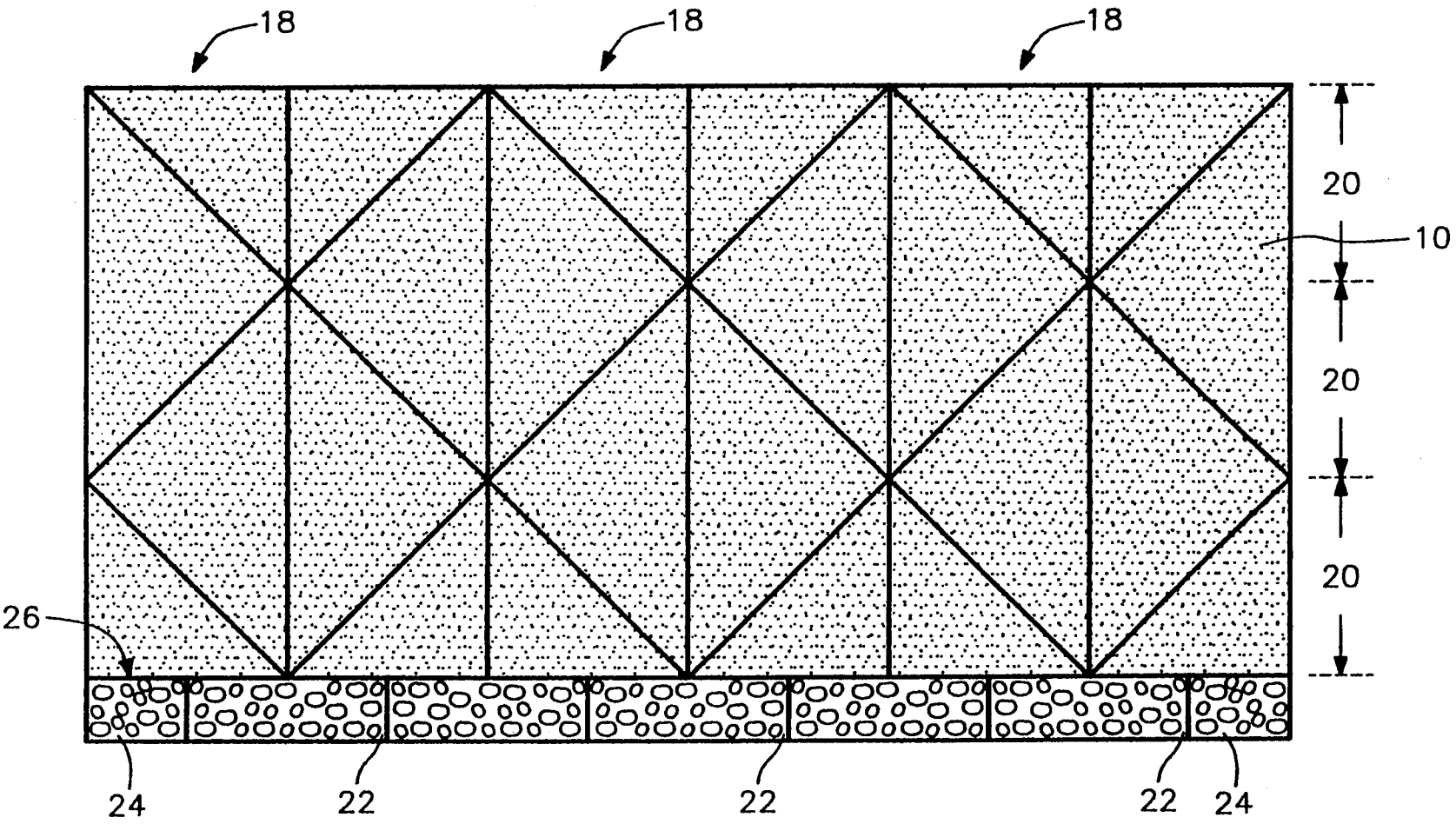
FIG. 2 is a plan view of a series of interconnected geocells having a facing panel.

With reference to the drawings, in general, and to FIGS. 1 and 2, in particular, a geocell embodying the teachings of the subject invention is generally designated as 10. In the view of FIG. 1, the geocells 10 are of triangular configuration and are interconnected in the manner described in U.S. Pat. No. 4,530,622 to Mercer, hereby incorporated by reference. Interconnected triangular geocells form a rectangular configuration.

In the embodiment shown in FIG. 1, a retaining wall is formed by an interconnection of six rows of geocells 10 at one meter width and having a depth of three sections in each of the rows of geocells at one meter width each to form a three meter width. The leading edge 12 of the retaining structure formed by the shown geocells includes geocells 11 filled with stone fill or concrete 14. Each of the geocells 10 having an edge located rearwardly of the leading edge 12 are filled with sand 16.

In the structure shown, the geocells have a height of 1.3 meters. Therefore, the stone volume/unit length equals 0.65 $m^3/m$ or 0.26 $yards^3$ (CY)/linear foot (LF).

By locating the stone or concrete filled geocells 11 at the leading edge 12 of the retaining structure, an advantage is obtained over prior practices by limiting the exposure of the sand filled geocells 10 to natural forces, such as waves, except at the exposed corners of the interconnected geocells 10 filled with sand and the geocells 11 filled with stone as illustrated at points A of FIG. 1. With this configuration it might be possible for the geotextile which retains the sand fill to be damaged resulting in piping loss of granular material.

In the preferred embodiment of FIG. 2, and as a further improvement over the FIG. 1 embodiment, each of the triangular geocells 10 filled with sand, forms six rows 18 of geocells 10, and three rows 20 as indicated by dotted lines. However in FIG. 2, a series of interconnected facing panel compartments 22, each having a width of one meter and a depth of 0.3 meters, are aligned along a leading edge 26 of the sand filled geocells 10. The two end facing panel compartments 24 have a width of 0.5 m so as to stagger an interconnection of corners of facing panel compartments to be offset from an interconnection of corners of sand filled geocells 10.

The facing panel compartments 22, 24 at a width of 0.3 m are filled with stone or concrete and occupy a stone volume/unit length of 0.40 $m^3/m$ or 0.16 CY/LF. As compared to the FIG. 1 embodiment, a significant savings in stone fill or concrete is achieved and all points of egress of sand from sand filled geocells 10 are blocked by the staggered facing panel compartments 22, 24, which are offset from the interconnection of geocells 10.

Figure 2A:
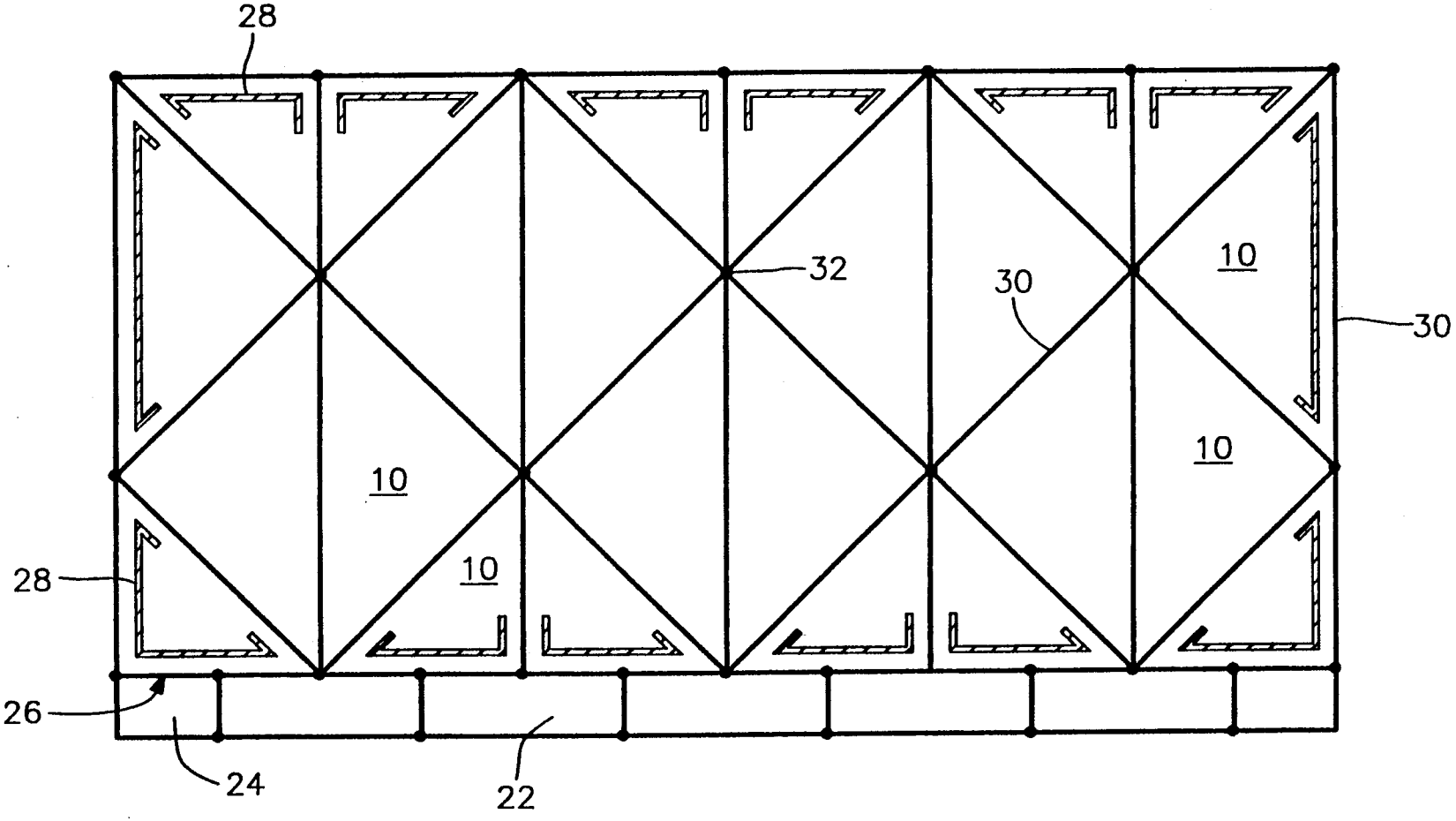
FIG. 2A is a schematic view of the interconnected geocells having a facing panel shown in FIG. 2.

Therefore, repeated wave action against the retaining structure shown in FIG. 2 is prevented from causing the loss of sand fines. This advantage is schematically shown in FIG. 2A which illustrates a location of geotextile liners 28 at the outer periphery of the shown retaining structure, as formed by sections of UX geogrid 30.

The interconnection between sections of UX geogrid 30 is accomplished by Bodkin joints 32, illustrated by dots in the drawings between the intersections of various geocells 10. The interconnection of the adjacent geocells 10 along the length of edge 26 and the interconnection of adjacent stone filled facing panel compartments 22 and 24 are offset such that the interconnections are formed in a staggered pattern along the edge 26. The staggered arrangement of Bodkin joints along the edge 26 in FIG. 2A is used to interconnect together geocells 10 and the connected geocells 10 to the facing panel compartments 22, 24. The loss of fines through the Bodkin joints is thereby limited, as also reinforced by the presence of geotextile liner along the outer edges of the sand filled geocells.

Assuming that the facing panel compartments have a width of 0.15 m (approximately 6 inches), which is probably the smallest feasible thickness for construction purposes to provide adequate protection for the geotextile to back the stone fill and prevent loss of granular fill, the stone volume/unit length equals 0.4 $m^3/m$ (or 0.16 $yard^3$/linear foot). This compares even more favorably with the FIG. 1 stone volume/unit length than the stone volume/unit of FIG. 2 with a 0.3 m facing panel compartment width.

Figure 3:
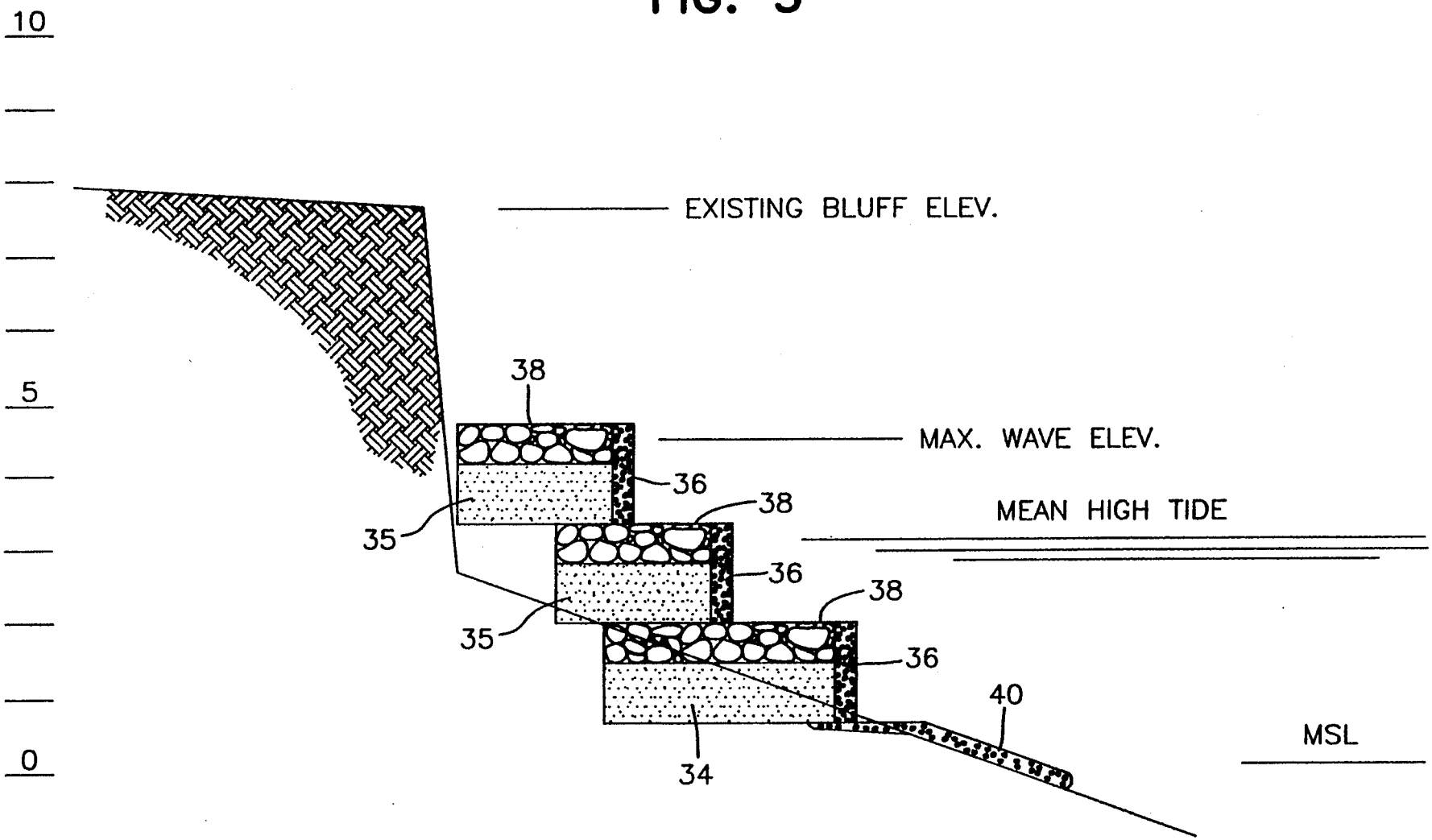
FIG. 3 is a sectional view of geocells with facing panels in a stair step geometry.

In FIG. 3, a stair step configuration is shown, as required for a specific site requirement. In this Figure, a plurality of offset, overlapping, sand filled geocells 34 include a vertically rising facing panel 36 filled with small stones with the panel 36 rising to a height equal with a horizontally extending facing panel 38 filled with larger stones.

The retaining structure formed includes a toe blanket 40 for anchoring of the stacked and staggered geocells with geocell 34 being of a three by six meter configuration as shown in FIGS. 1, 2 and 2A and geocells 35 being of a two by six meter configuration. The geocells are located above the mean sea level (MSL) with the center of the height of the formed retaining structure being at the mean high tide level and the uppermost geocell being located at the maximum wave elevation, which is located below an existing bluff elevation.

Figure 4:
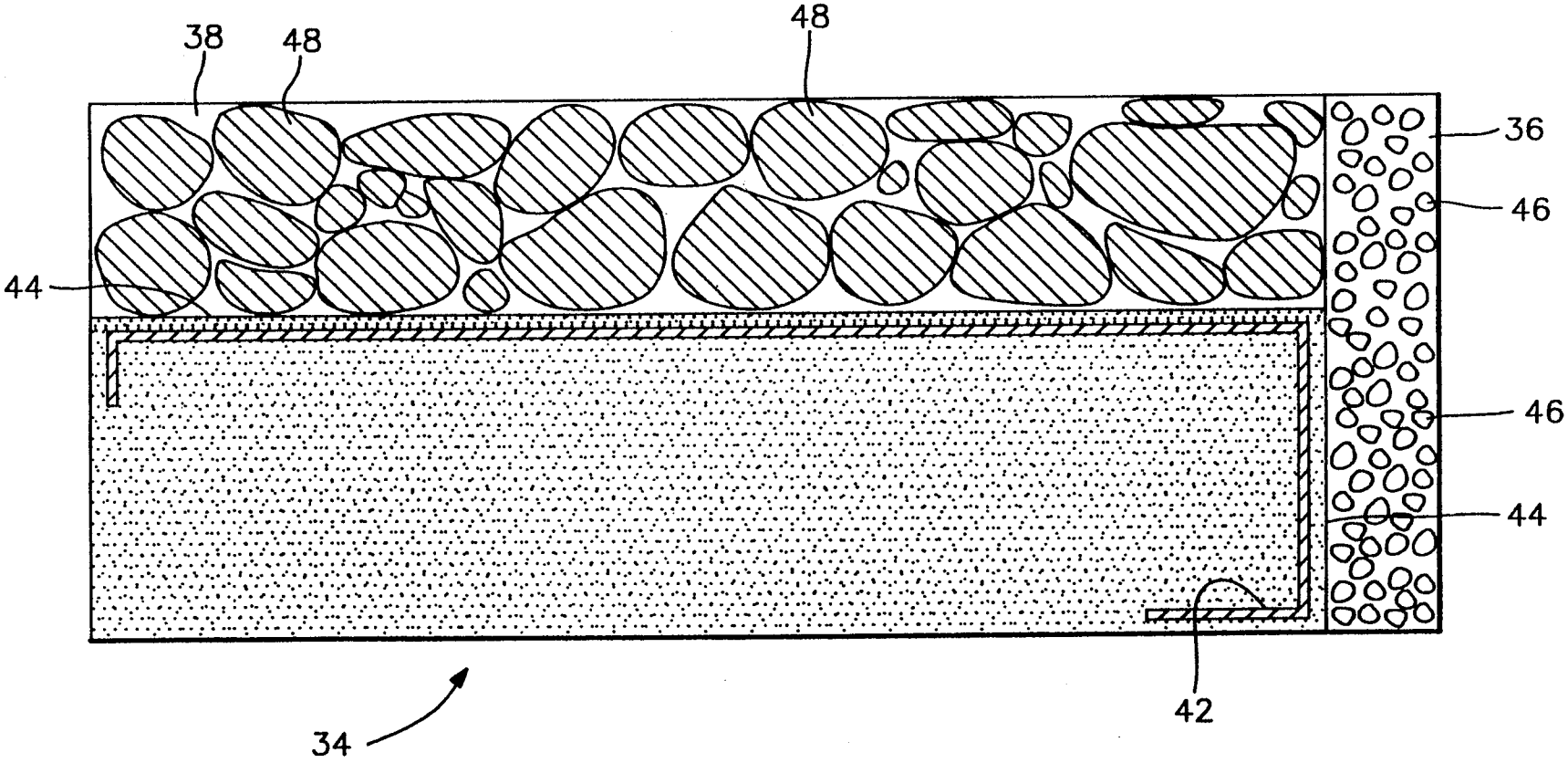
FIG. 4 is a cross-sectional view of a geocell having facing panels used in a stair step geometry.

In FIG. 4, an enlarged view of geocell 34 is shown including geotextile liner 42 being located at the edges which would be exposed to wave action. The liner 42 is spaced inwardly of UX geogrid sections 44, which form the outer periphery of the geocell.

The facing panel 36 is shown filled with small stones 46 as compared to the larger size stones 48 located in the horizontal extending facing panel 38.

Figure 5:
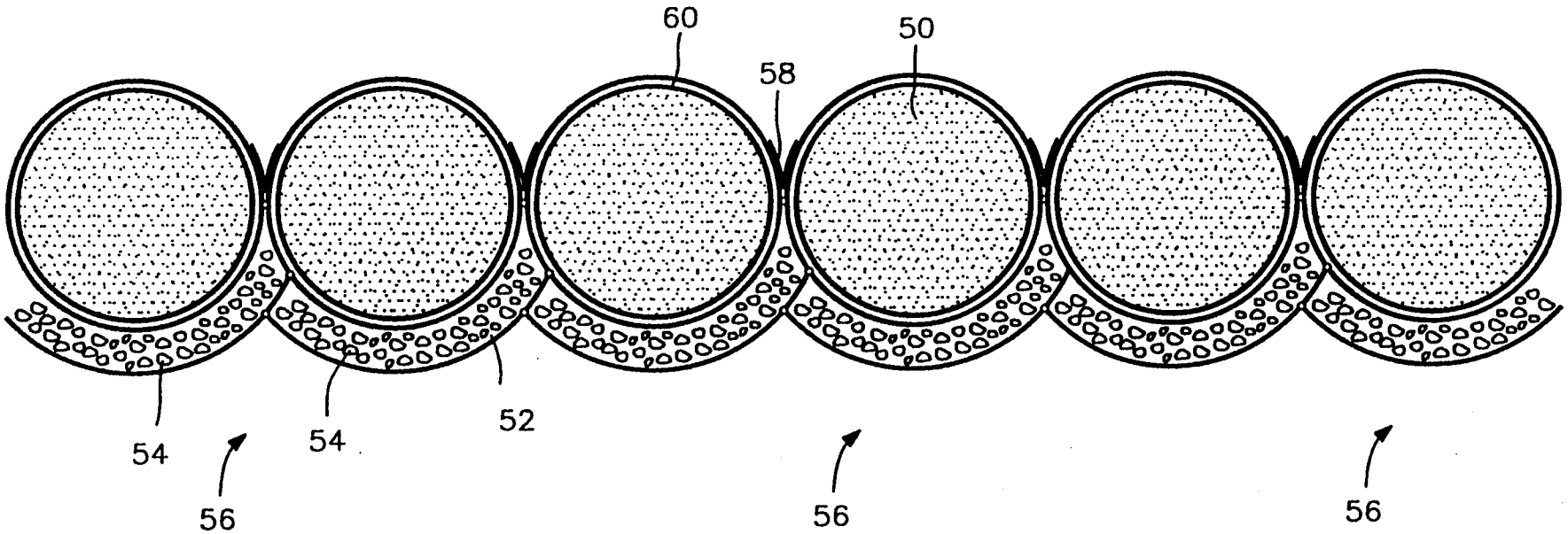
FIG. 5 is a plan view of circular geocells having facing panels.

As an alternative configuration of a geocell, circular geocells 50 are shown in FIG. 5 having a height of 1.3 meters and a diameter of 2 meters. Circular geocells provide external stability for the internal granular fill dependent upon hoop stress. The dimensions of the circular cell are dependent upon the stresses induced in the geogrids used and the properties of the backfill material. The circular geocells are used as wave breaks, retaining walls, jetties, wharves and numerous other structures. The circular geocells also provide a significant capacity to carry surface loads due to the confining pressures generated by the geogrids.

Figure 6:
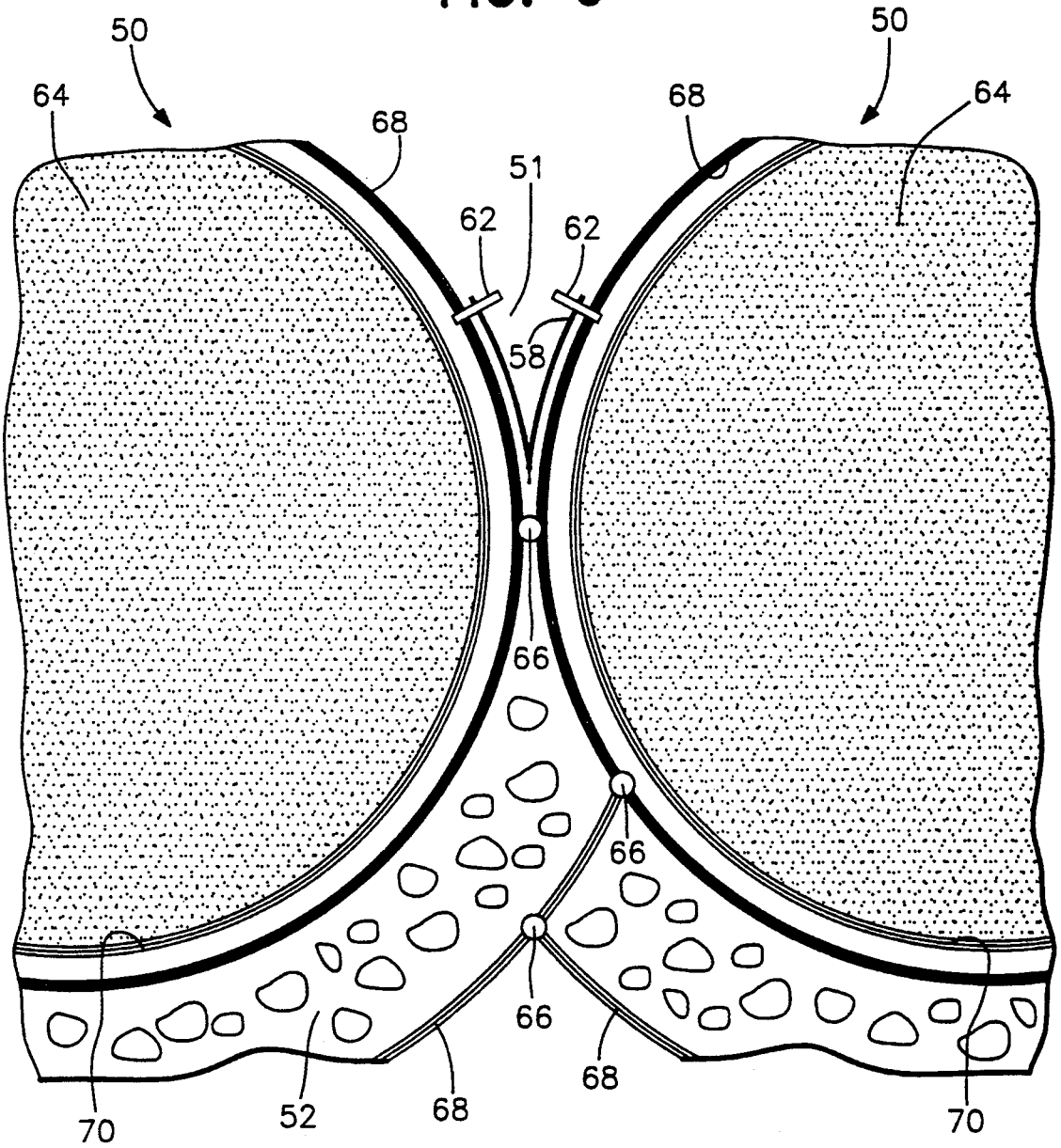
FIG. 6 is an enlarged section of a plan view of two circular geocells with facing panels.

The interconnection of adjacent circular geocells 50 is shown in greater detail in FIG. 6 as well as the interconnection with the arcuate facing panel compartments 52 which are filled with stones 54 to act against forces moving in the direction of arrows 56.

In an alternate embodiment, circular geocells 50 are formed without facing panels. The geocells are interconnected by Bodkin joints in a row along a central axis coincident with a diameter of each geocell.

It is noted that strips of geotextile liner 58 are secured on a rear surface 60 of geocells 50, adjacent the connection point of adjacent circular geocells 50. As shown in FIG. 6, the geotextile liner strips 58 are connected by two plastic or wire ties 62 to the top and two at the bottom of the circular geocells 50 so that fines of sand 64 are prevented from escaping from between the circular geocells 50. No additional ties are required since the earth fill behind the geocell will force the geotextile into the V-shaped void 51 until it is firmly pressed against the periphery of the two adjacent cells. This will effectively form a barrier to the loss of fines being piped from the system. The external geotextile strip is pressed between the apertures of the geogrids against the inner geotextile liner to provide positive piping control.

A series of Bodkin joints 66 interconnect the outermost layer of uniaxial geogrid 68 forming the outer surface of the circular geocells 50 and the facing panel compartments 52. Located internally of the uniaxial geogrid 68 of the circular geocells 50 is geotextile liner 70. This provides reinforcement for the sand fill retained within the circular geocells 50 and is reinforced by the geotextile liner strips 58 located rearwardly of the Bodkin joints 66 between adjacent circular geocells.

Figure 6A:
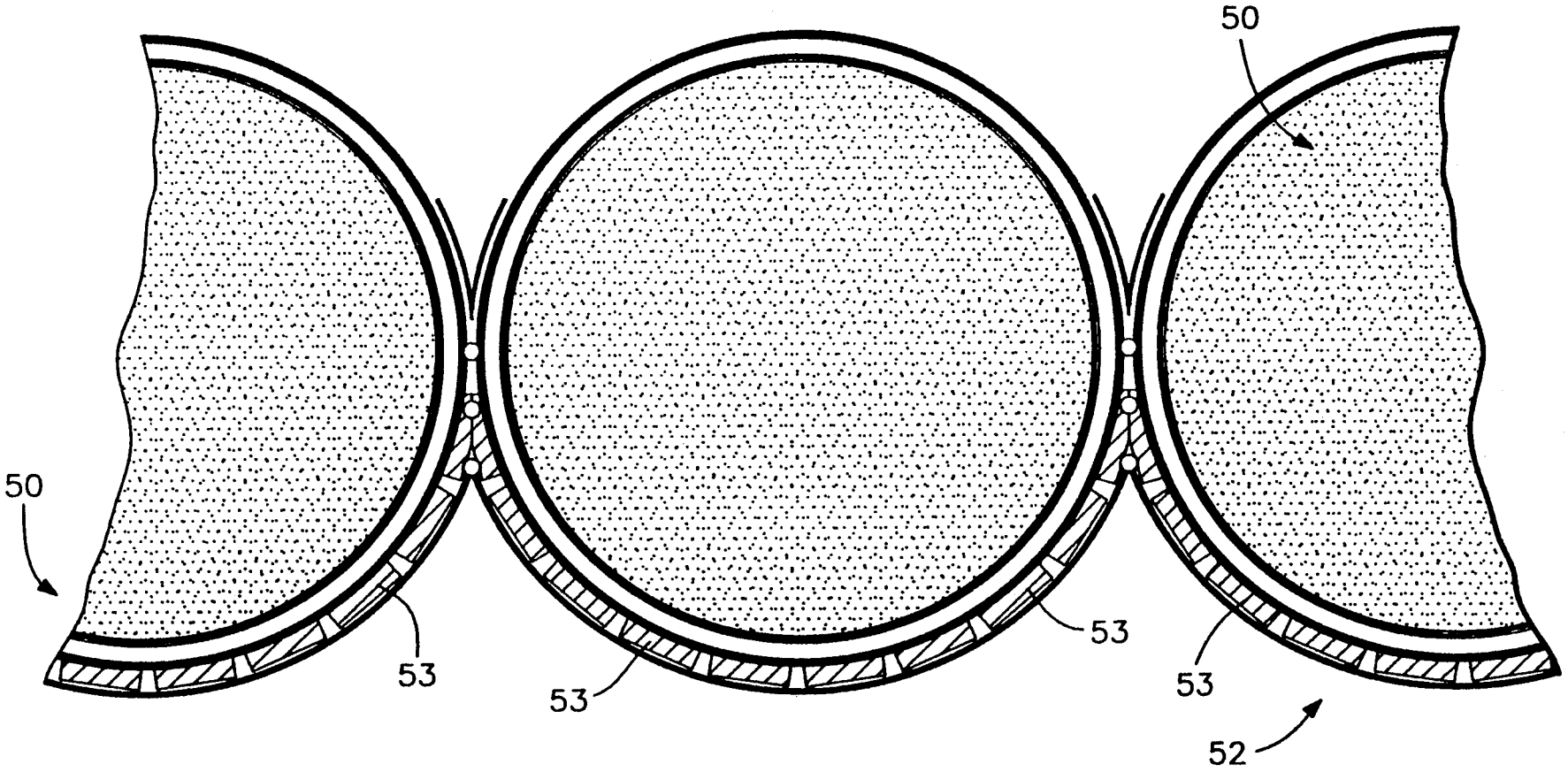
FIG. 6A is a plan view of circular geocells having facing panels with wooden boards, plastic sheets or steel sheets.

In FIG. 6A, circular geocells 50 include facing panel compartments 52 as is disclosed in FIGS. 5 and 6. However, in FIG. 6A the compartments 52 include elongated fill material 53, formed of wooden boards, plastic sheets or steel sheets, which extend parallel to a longitudinal axis of the geocells 50. The fill material extends out the bottom of the compartments 52 to a depth of two to three feet to anchor the geocells 50 in position.

Figure 7:
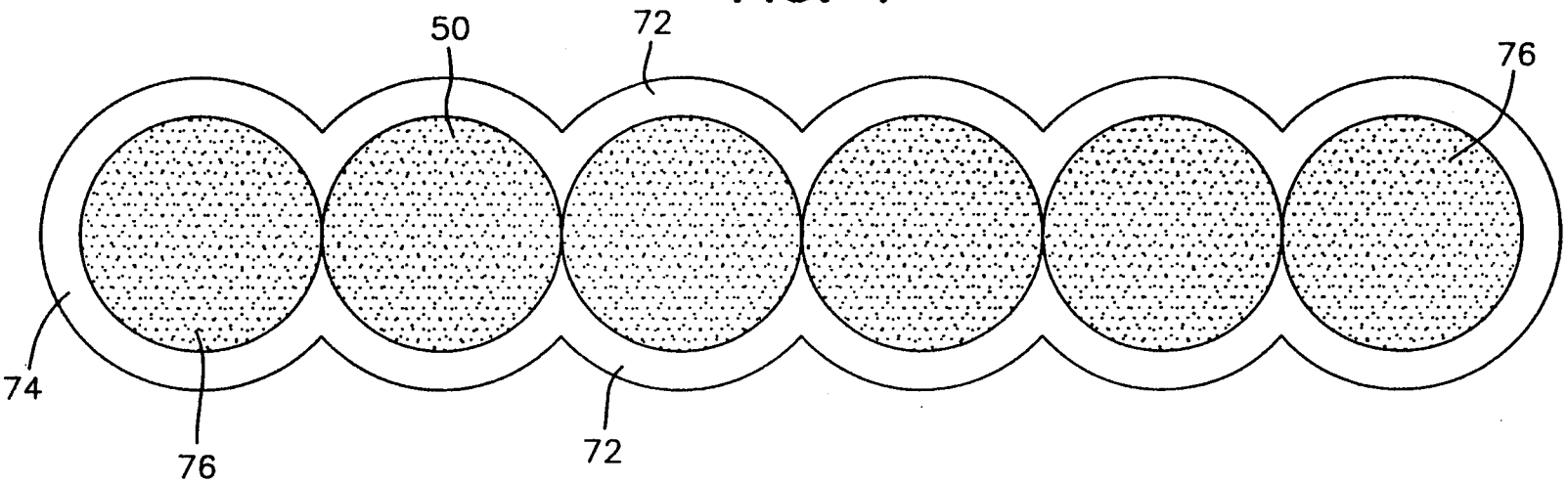
FIG. 7 is a plan view of circular geocells having facing panels to form a wharf.

In FIG. 7, circular geocells 50 are shown having facing panel compartments 72 located on opposite sides of an internally isolated circular geocell 50 with the facing panel compartments 74 extending substantially about the periphery of the two end circular geocells 76 to form a wharf configuration. In FIG. 7, the facing panel compartments 72 and 74 are filled with stone and capped with concrete to form a deck extending across the tops of the circular geocells.

Figure 8:
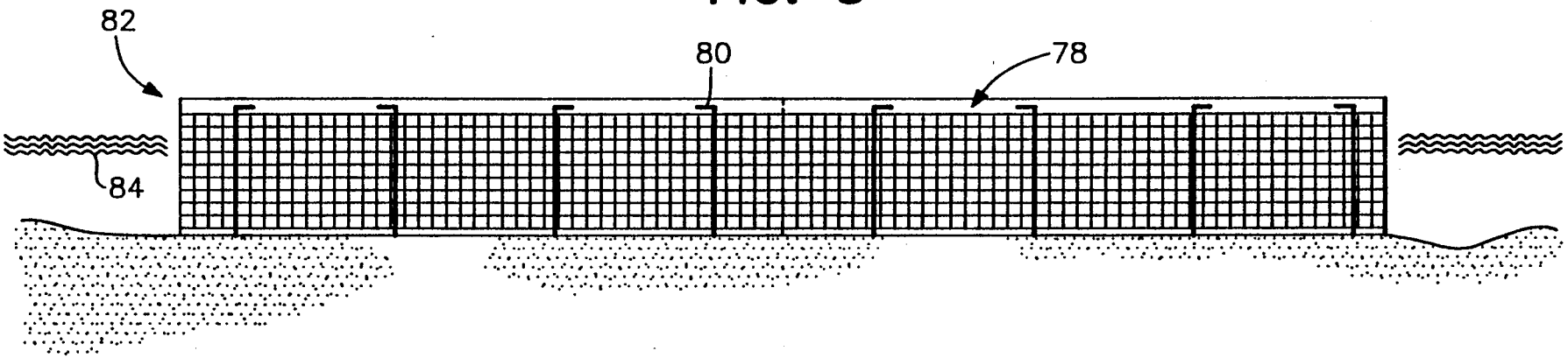
FIG. 8 is a side elevational view of a wharf formed by circular geocells having facing panels.

In FIG. 8, concrete cap 78 is shown extending above the circular geocells while uniaxial geogrid anchors 80 extend between adjacent circular geocells 50 and 76. The anchors 80 are secured in place within the concrete cap 78 of the formed wharf 82. The wharf is located to extend slightly above sea level 84.

Having described the invention, many modifications thereto will become apparent to those skilled in the art to which it pertains without deviation from the spirit of the invention as defined by the scope of the appended claims.

I claim:

1. A geotechnical structure comprising:

a plurality of interconnected geocells, each geocell including a geogrid material defining a boundary wall, a geotextile liner extending about the interior of said geocell in juxtaposition to said geogrid material, and fill material contained within said geocell, said fill material being of a size greater than openings of said geotextile liner and primarily of a size smaller than openings of said geogrid material, said geotextile liner being located between said fill material and said geogrid material to retain said fill material within said geocell, said plurality of geocells together defining a peripheral side wall formed by portions of the boundary walls of at least some of said plurality of geocells, and a facing panel secured to said interconnected geocells and covering at least all portions of said peripheral side wall exposed in use to environmental forces including ultraviolet radiation so as to prevent deterioration, primarily of said geotextile liner and ultimately failure of the geocell itself.

2. A geotechnical structure as claimed in claim 1, wherein said geocells are filled with sand.

3. A geotechnical structure as claimed in claim 1, wherein said geocells are filled with shells.

4. A geotechnical structure as claimed in claim 1, wherein said geocells are triangular.

5. A geotechnical structure as claimed in claim 1, wherein said geocells are circular.

6. A geotechnical structure as claimed in claim 1, wherein said geocells are stacked on top of each other.

7. A geotechnical structure as claimed in claim 1, wherein said facing panel extends vertically.

8. A geotechnical structure as claimed in claim 1, wherein said facing panel extends vertically and horizontally.

9. A geotechnical structure as claimed in claim 1, wherein said interconnected geocells are capped with concrete.

10. A geotechnical structure comprising:

a plurality of interconnected substantially circular geocells, each geocell including a geogrid material defining a substantially circular boundary wall for receiving fill material, said boundary wall being flexible to assume a circular shape with equal tensioning about its periphery when filled with said fill material.

11. A geotechnical structure as claimed in claim 10, wherein said circular geocells include a geotechnical liner extending about the interior of said substantially circular geocells in juxtaposition to said geogrid material.

12. A geotechnical structure as claimed in claim 10, wherein said circular geocells are filled with sand.

13. A geotechnical structure as claimed in claim 10, wherein a facing panel is secured to said plurality of interconnected substantially circular geocells and covering at least all portions of a peripheral side wall formed by portions of the boundary walls of at least some of said plurality of interconnected substantially circular geocells so that said peripheral side wall is prevented from being exposed to environmental forces including ultraviolet radiation to thereby prevent deterioration, primarily of said geotextile liner and ultimately failure of the geocell itself.

14. A geotechnical structure as claimed in claim 13, wherein an externally located geotextile strip is secured to said plurality of interconnected substantially circular geocells on a side of said geocells located opposite to said facing panel.

15. A geotechnical structure as claimed in claim 13, wherein said facing panel extends completely around said interconnected circular geocells.

16. A geotechnical structure as claimed in claim 13, wherein a concrete cap interconnects said interconnected substantially circular geocells.

17. A geotechnical structure comprising:

a plurality of interconnected geocells, each geocell including a geogrid material defining a boundary wall, a geotextile liner extending about the interior of said geocell in juxtaposition to said geogrid material, and fill material contained within said geocell, said fill material being of a size greater than openings of said geotextile liner and primarily of a size smaller than openings of said geogrid material with said geotextile liner located between said fill material and said geogrid material to retain said fill material within said geocell, and said plurality of interconnected geocells being partially buried in a water environment with portions of said peripheral side walls exposed to environmental forces including ultraviolet radiation so as to prevent deterioration primarily of said geotextile liner and ultimately failure of the geocell itself, and a facing panel secured to at least one side edge of said interconnected geocells and covering at least said portions of peripheral side walls to protect exposed surfaces of said geotextile liner from deterioration forces.

18. A geotechnical structure as claimed in claim 17, wherein said geocells are filled with sand.

19. A geotechnical structure as claimed in claim 17, wherein said geocells are filled with shells.

20. A geotechnical structure as claimed in claim 17, wherein said geocells are triangular.

21. A geotechnical structure as claimed in claim 17, wherein said geocells are circular.

22. A geotechnical structure as claimed in claim 17, wherein said geocells are stacked on top of each other.

23. A geotechnical structure as claimed in claim 17, wherein said facing panel extends vertically.

24. A geotechnical structure as claimed in claim 17, wherein said facing panel extends vertically and horizontally.

25. A geotechnical structure to be filled with fill material in a water environment, said geotechnical structure comprising:

a plurality of interconnected geocells, each geocell including a geogrid material defining a boundary wall, a geotextile liner extending about the interior of said geocell in juxtaposition to said geogrid material for receipt of fill material within said geocell of a size greater than openings of said geotextile liner and primarily of a size smaller than openings of said geogrid material with said geotextile liner being located between said fill material and said geogrid material to retain said fill material within said geocell, said plurality of geocells together defining a peripheral side wall formed by portions of the boundary walls of at least some of said plurality of geocells, and a facing panel secured to said interconnected geocells, and when in use, covering at least all portions of said peripheral side wall exposed in use to environmental forces including ultraviolet radiation so as to prevent deterioration, primarily of said geotextile liner and ultimately failure of the geocell itself.

26. A geotechnical structure comprising:

a plurality of interconnected geocells, each geocell including a geogrid material defining a boundary wall, a geotextile liner extending about the interior of said geocell in juxtaposition to said geogrid material, and fill material contained within said geocell, said fill material being of a size greater than openings of said geotextile liner and primarily of a size smaller than openings of said geogrid material, said geotextile liner being located between said fill material and said geogrid material to retain said fill material within said geocell, said plurality of geocells together defining a peripheral side wall formed by portions of the boundary walls of at least some of said plurality of geocells, said fill material located in said geocells having said boundary walls forming said peripheral side wall being different from fill material located in said geocells primarily located rearwardly from said peripheral side wall.

27. A method of erecting a geotechnical structure comprising:

interconnecting a plurality of geocells, each geocell including a geogrid material defining a boundary wall, locating a geotextile liner about the interior of said geocell in juxtaposition to said geogrid material, placing fill material with said geocell of a size greater than openings of said geotextile liner and primarily of a size smaller than openings of said geogrid material, said geotextile liner being located between said fill material and said geogrid material to retain said fill material within said geocell, forming a peripheral side wall of said plurality of geocells by portions of the boundary walls of at least some of said plurality of geocells, and securing a facing panel to said interconnected geocells, said facing panel covering at least all portions of said peripheral side walls exposed in use to environmental forces including ultraviolet radiation so as to prevent deterioration, primarily of said geotextile liner and ultimately failure of the geocell itself.

* * * * *

UNITED STATES PATENT AND TRADEMARK OFFICE

CERTIFICATE OF CORRECTION

PATENT NO. : 5,320,455

DATED : June 14, 1994

INVENTOR(S) : Robert M. MATTOX

It is certified that error appears in the above-identified patent and that said Letters Patent is hereby corrected as shown below:

At column 9, claim 17, lines 6-8, delete "so as to prevent deterioration primarily of said geotextile liner and ultimately failure of the geocell itself"; and at column 9, claim 17, line 13, after "forces", insert --so as to prevent deterioration, primarily of said geotextile liner and ultimately failure of the geocell itself--.

Signed and Sealed this

Eighteenth Day of October, 1994

*Attest:*

*Attesting Officer*

Bruce Lehman

BRUCE LEHMAN

*Commissioner of Patents and Trademarks*